US006945578B2

(12) United States Patent
Hellerson

(10) Patent No.: US 6,945,578 B2
(45) Date of Patent: Sep. 20, 2005

(54) BALL RETRIEVAL AND STORAGE DEVICE

(75) Inventor: Robert K. Hellerson, Lakewood, NJ (US)

(73) Assignee: J.A. Cissel Mfg. Co., Lakewood, NJ (US)

( * ) Notice: Subject to any disclaimer, the term of this patent is extended or adjusted under 35 U.S.C. 154(b) by 0 days.

(21) Appl. No.: 10/801,253

(22) Filed: Mar. 17, 2004

(65) Prior Publication Data

US 2004/0227365 A1 Nov. 18, 2004

Related U.S. Application Data

(60) Provisional application No. 60/469,528, filed on May 12, 2003.

(51) Int. Cl.[7] ..... A63B 47/02
(52) U.S. Cl. ..... 294/19.2
(58) Field of Search ..... 294/19.2; 206/315.9; 414/439, 440; 56/328.1

(56) References Cited

U.S. PATENT DOCUMENTS 3,926,465 A * 12/1975 Hoagland et al. ..... 294/19.2
4,184,707 A * 1/1980 Nelson et al. ..... 294/19.2
4,412,697 A * 11/1983 Verde ..... 294/19.2
5,301,991 A * 4/1994 Chen et al. ..... 294/19.2
5,464,262 A * 11/1995 Madrazo ..... 294/19.2
6,142,544 A * 11/2000 Benzoni et al. ..... 294/19.2
6,302,460 B1 * 10/2001 Carr ..... 294/19.2

* cited by examiner

*Primary Examiner*—Dean J. Kramer
(74) *Attorney, Agent, or Firm*—Clifford G. Frayne

(57) ABSTRACT

The ball retrieval and storage device includes a container having a hollow interior for storing a substantial number of tennis balls. At least a portion of the container bottom is formed by one or more movable rod members which are movable to allow the balls to enter through the bottom of the container. A user can retrieve a ball lying on the ground by forcing the bottom of the container down over the top of the ball. The ball engages the movable rod member and moves it slightly upwardly which allows the ball to enter the container as the container is progressively forced down over the top of the ball compressing the ball. The movable rod members are formed of a material having an elastic memory such that for use over time, the movable rod members will not permanently deform so as to decrease the efficacy of the ball retrieval and storage device.

5 Claims, 4 Drawing Sheets

BALL RETRIEVAL AND STORAGE DEVICE

RELATED APPLICATIONS

Applicant claims the benefit of provisional application Ser. No. 60/469,528, filed May 12, 2003.

BACKGROUND OF THE INVENTION

1. Field of the Invention

The present invention relates to devices which allow a user to pick up balls from the ground without substantial bending at the waist, and more particularly to an improved ball retrieval and storage device for picking up and storing tennis balls.

2. Description of the Prior Art

At one time many tennis players going to a tennis court for a practice session would take a bucket containing a large number of balls. Individual practice and teaching lessons generally involved a repetitive hitting of a large number of tennis balls and in some instances such practice sessions involve the use of machines for mechanically serving the balls to student players. Ultimately, the balls must be gathered from the ground into a receptacle to hold them before they are hit again. The job of retrieving balls requires a considerable amount of stooping and bending effort and time, and the time which is lost must be subtracted from that available for practice and play. The Applicant is successor and interest to U.S. Pat. No. 3,926,465 for a ball retrieving and storage device for picking up balls from the ground without substantial bending at the waist. Applicant has made improvements to one of the embodiments of the ball retrieving and storage device as disclosed in the aforesaid U.S. patent, which eliminates some of the shortcomings. In particular, Applicant has made improvements to the ball retrieval and storage device in the construction of the ball retrieval and storage device bottom frame and the use of an alternative material having elastic memory.

Originally, the ball retrieval and storage device was a wire mesh container with the moving parts being constructed of wire or coated wire in the form of rods. Over time, the method of use as described hereafter would cause the wire rods which comprise the gate structure to deform in shape and thereby lessen the efficacy of the ball retrieval and storage device. Still further, the spot welds securing the bottom frame member would weaken with use over time due to repeated contact with the ground when being forced over the tennis balls. Applicant's improvements have addressed these problems.

OBJECTS OF THE INVENTION

An object of the present invention is to provide for a novel improved ball retrieval and storage device for picking up balls from the ground.

Another object of the present invention is to provide for a novel improved ball retrieving and storage device for picking up tennis balls from the ground and which will not deteriorate through use over time.

A still further object of the present invention is to provide for a novel improved ball retrieving and storage device in which the movable rod member utilized to retrieve a ball from the ground is constructed from an elastic memory material.

A still further object of the present invention is to provide for a novel improved ball retrieving and storage device in which the movable rod members utilize to retrieve balls from the ground will not permanently deform over time with use.

SUMMARY OF THE INVENTION

The ball retrieval and storage device includes a container having a hollow interior for storing a substantial number of tennis balls. At least a portion of the container bottom is formed by one or more movable rod members which are movable to allow the balls to enter through the bottom of the container. A user can retrieve a ball lying on the ground by forcing the bottom of the container down over the top of the ball. The ball engages the movable rod member and moves it slightly upwardly which allows the ball to enter the container as the container is progressively forced down over the top of the ball compressing the ball. The movable rod member ultimately passes the equator of the ball and a stop means mounted on the container limits the upward movement of the movable rod member. The raised movable rod member thus is held momentarily in a fixed position by a stop means to allow a major portion of the ball to pass through the opening in the container bottom. The movable rod member is then automatically released from the contact and the ball and the stop means to drop to its closed position to provide a portion of the container bottom which will retain the ball in the container. The movable rod members are formed of a material having an elastic memory such that for use over time, the movable rod members will not permanently deform so as to decrease the efficacy of the ball retrieval and storage device.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 1:
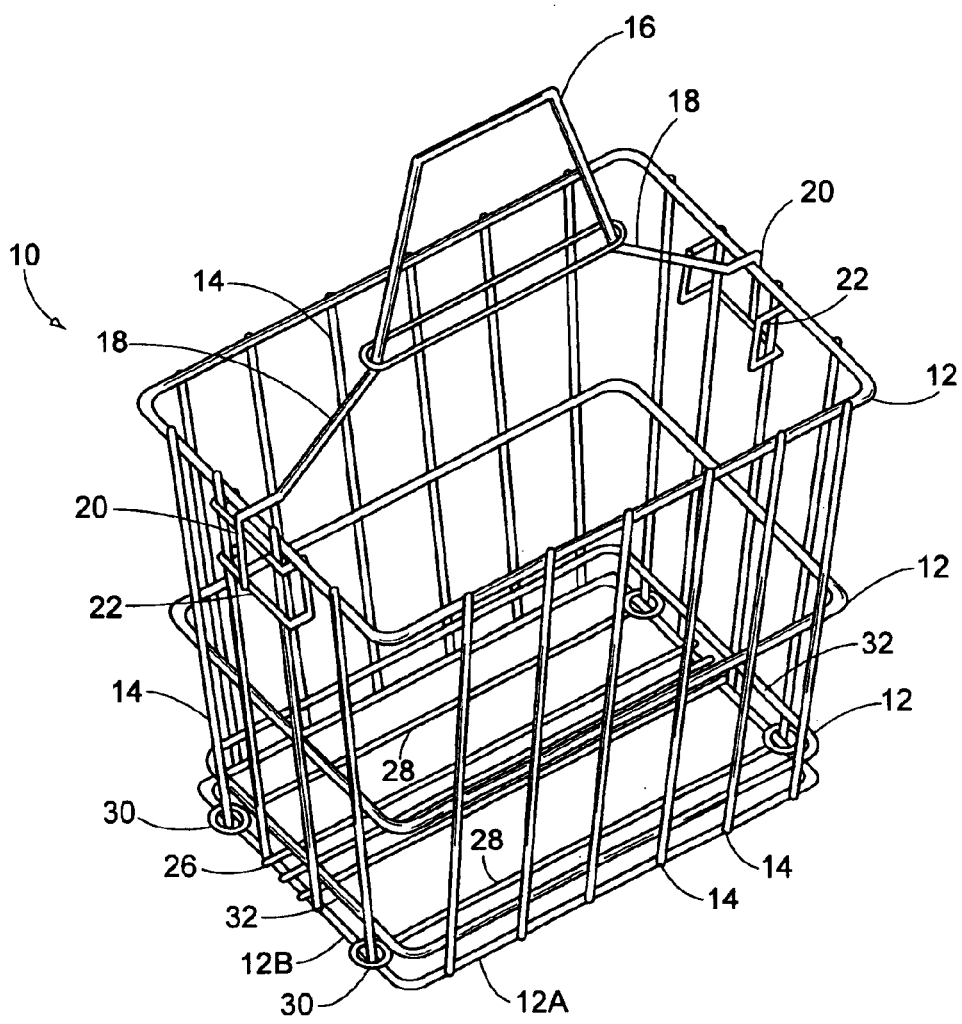
FIG. 1 PRIOR ART
FIG. 1 is a perspective view of the ball retrieval and storage device of the prior art.
Figure 2:
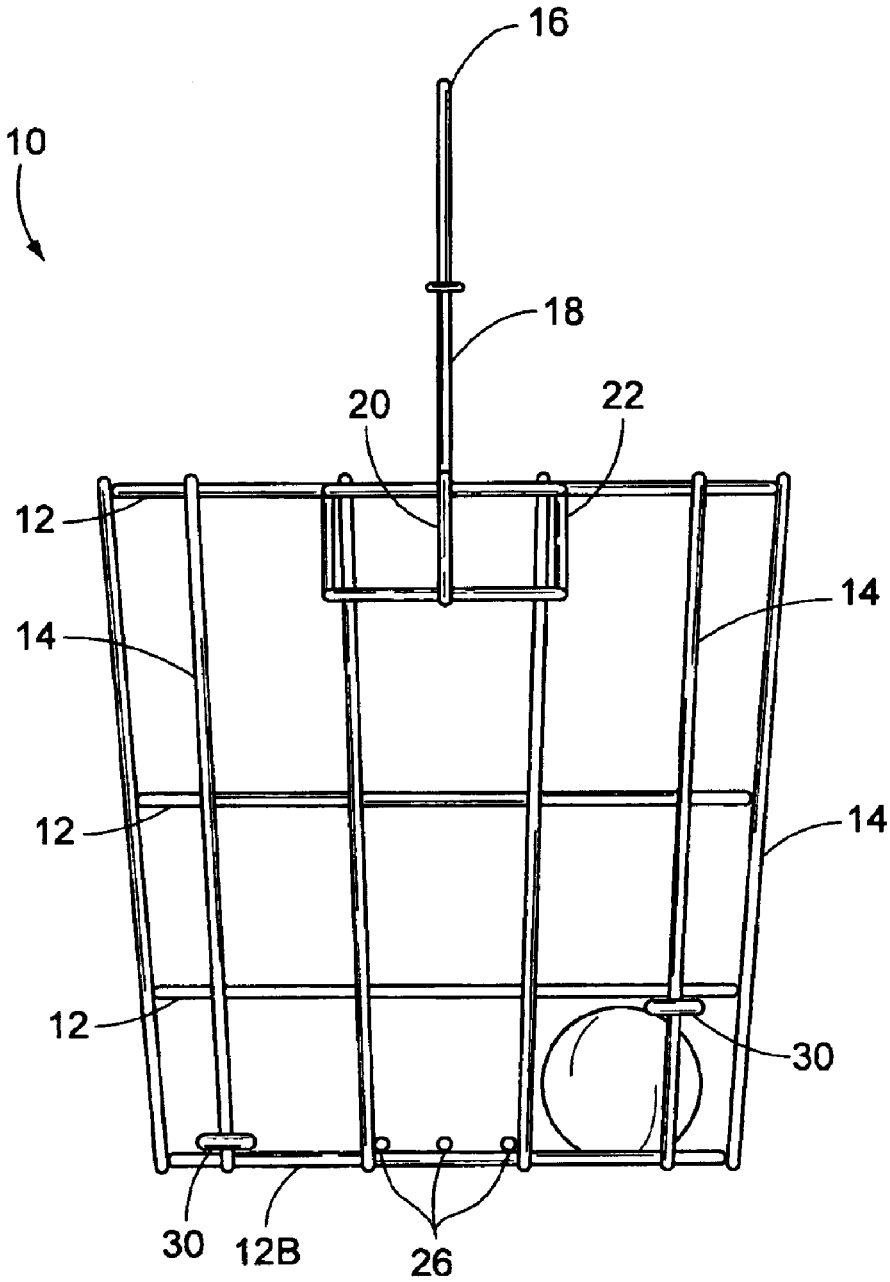
FIG. 2 PRIOR ART
FIG. 2 is an end view of the ball retrieval device of the prior art.

Referring to FIGS. 1 and 2, a typical ball retrieving and storage device 10 of the prior art includes an open top container made of intersecting rods constructed of wire tubes or other suitable material. The container includes several vertically spaced apart rectangular rod frames 12 lying in substantial parallel planes. The bottom rectangular frame 12 includes long legs 12A and short legs 12B. The rectangular frames are oriented relative to each other so that their corners are in common substantially vertical planes. A series of substantially upright elongated rods 14 lying in mutually substantially parallel planes are secured to the outer edges of the rectangular frames to form a rigid, rectangular, skeleton framework for the container. The enclosed areas of the rectangular frames progressively increase towards the top of the container and upright legs 14 diverge slightly outwardly from each other so that the container has outwardly tapered side walls.

The downwardly opening substantially U-shaped elongated rotatable handle 16 extends above the container. The handle includes legs 18 which taper narrower towards the top of the handle. The bottom portions of the legs are bent outwardly and then extend downwardly at 20 for attachment to a substantially U-shaped frame like bracket 22 which open inwardly toward the container and extend around respective pairs of container legs 14 at opposite ends of the container.

In the prior art, the bottom of the container preferably includes one or more elongated fixed center rod 26 extending parallel to long legs 12A of rectangular bottom frame 12 and rigidly secured to the top of the frames short legs 12B along the center line. The bottom of the container would also include a plurality of spaced apart movable rods or gate members 28 traversing between short frame legs 12B. Both movable gate members 28 extend substantially parallel to the fixed rod 26, each gate member being loosely fitted at its end to opposite sides of the container so that the gate member 28 can move vertically up and down relative to the bottom frame legs 12A and 12B on a pair of upright elongated rods 14. Preferably, each gate member 28 comprises an elongated rounded rod formed of metal and which is bent at its opposing ends to form a loop 30 which fits loosely around a pair of the corresponding vertically extending upright rods 14 on opposite sides of the container. This means of attachment provided by loops 30 is sufficiently loose that each gate member will be allowed to slide easily up and down on rods 14 irrespective of the slight outward taper in the two opposed rods 14. Upward vertical movement of gate members 28 is limited by a pair of elongated substantially horizontal extending stop bars 32 which are rigidly secured to upright legs 14 on opposing sides of the container. Alternatively upward vertical movement would be limited by the rectangular frame member 12 immediately above loop 30. Each stop bar is attached above loops 30 to limit the upward travel of gate members 28. The use of the ball retrieving and storage device 10 in the prior art for picking up tennis balls require downward pressure on the container so the tennis balls would contact either the long leg 12A of the bottom frame and one of the gate members 28 or one of the gate members 28 and the fixed center rod 26 slightly compressing the tennis ball and displacing gate member 28 upwardly and allowing it to be forced up and into the container. The movable gate members 28 dropping back to their lower position prevent the release of any tennis ball already in the container, since that tennis ball would not be subjected to any pressure in the downward movement of the container. The shortcoming of the prior art was that the movable gate members 28 would oftentimes become deformed over time and use such that they would not easily allow the entrance of a tennis ball into the container and would not at all times prevent the release of a tennis ball through the bottom of the container. Still further, the problem with the retriever of the prior art was that the plurality of spot welds about bottom frame 12 would often become weakened over time because of the pressure exerted thereon and the repeated contact with the ground in picking up tennis balls. Applicant has solved this problem through a better design of the tennis ball retriever and receptacle, and in particular with the bottom frame member and moving rods associated therewith.

Figure 3:
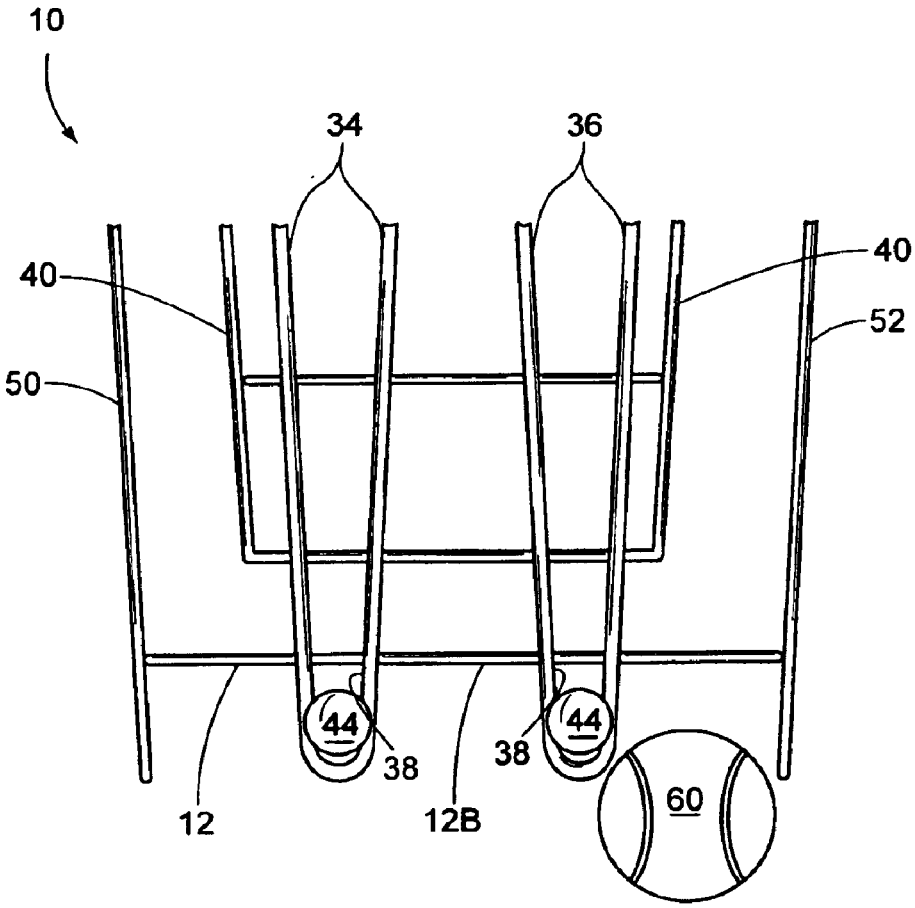
FIG. 3 is an end view of the lower portion of the ball retrieval and storage device of the present invention illustrating its improved structures.
Figure 4:
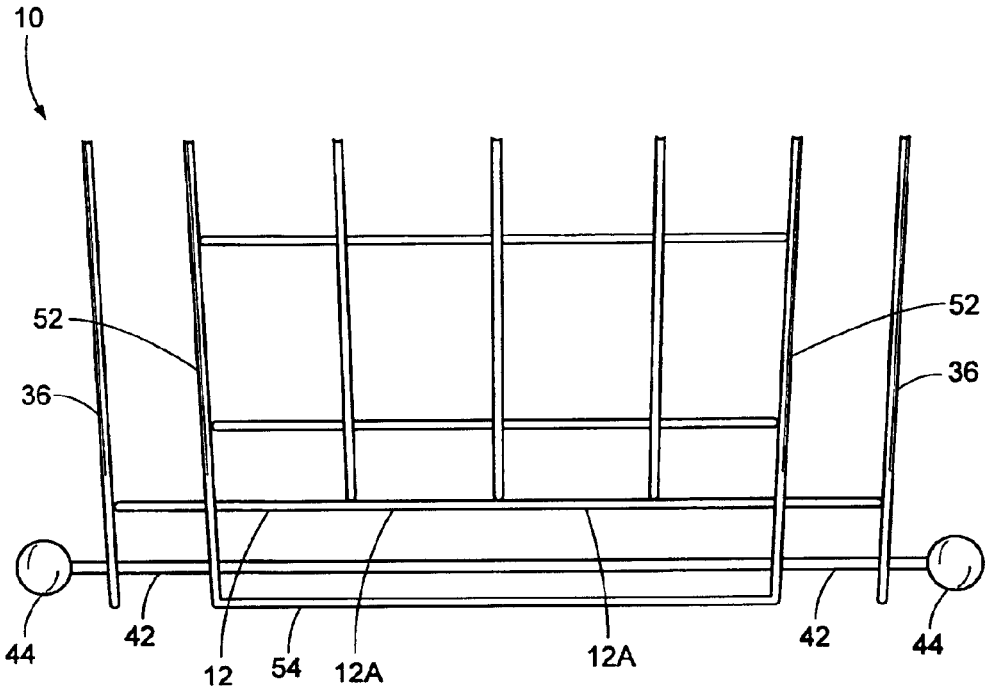
FIG. 4 is a side view of the lower portion of the ball retrieval and storage device of the present invention illustrating its improved structure.

Applicant's improvements to the ball retrieval and storage device 10 are best illustrated with reference to FIGS. 3 and 4 which illustrate the improvements to the area around the lowest frame member 12. Lower frame member 12 is still rectangular in shape with long legs 12A and short legs 12B. However, the vertical rods forming the walls of the ball retrieval and storage device 10 are redesigned from the prior art and their connections to lower frame member 12 have been modified. With reference to short legs 12B, the vertical legs 34 and 36 are defined by generally U-shaped wire members which taper inwardly from the top of the container to the bottom of the container forming a U-shaped aperture 38 below short leg member 12B. A retaining wire mesh 40 is secured to these generally U-shaped legs 34 and 36 between lower frame member 12 and the upper frame member 12 to retain the tennis balls within the container once retrieved. A separate set of vertical U-shaped legs 34 and 36 are secured at the opposing side of the container to short leg 12B.

There is positioned in aperture 38 between U-shaped legs 34 and 36, and their opposing counterparts, movable rod members 42 which are formed of an elastic memory material and extend through the U-shaped apertures 38 formed by the U-shaped leg members 34 and 36 and bottom frame member 12B. On the ends of the elastic memory rods 42 there is formed a retaining sphere 44 having a diameter larger than U-shaped apertures 38 so as to retain the movable rod members within U-shaped apertures 38 but which allows slight movement within such U-shaped apertures.

On long legs 12A, of ball retrieval and storage container 10, there is formed a pair of U-shaped vertical legs 50 and 52 which extend from upper frame member 12 to a point below lower frame member 12 such that the cross member 54 of the U-shaped leg members 50 and 52 is in a plane equal to the plane of the lower most point of U-shaped leg members 34 and 36 secured to the short leg 12B of lower frame member 12A.

In this design, when the retrieval and storage container 10 is utilized to retrieve tennis balls 60, the contact points with the ground with respect to the ball retrieval and storage device 10 are the cross members 54 of the generally U-shaped members 50 and 52 of long leg 12A of container 10 and the lower most points as defined by U-shaped leg members 34 and 36 on short leg members 12B of container 10. A ball retriever and storage device of this design has been found to preserve the integrity of the spot welds around the container over usage and time.

The movable rod members 42 being constructed of an elastic memory material such as fiberglass may deform slightly in use when the tennis balls are compressed either between the adjacent movable rod members 42 or between a movable rod member 42 and long leg 12A of lower frame member 12, however, it being constructed of an elastic memory material, they will return to their original shape and thus provide extended life to the ball retrieval device in both retrieving tennis balls from the ground and retaining tennis balls within the basket once retrieved. Material suitable for movable rod members 42 in order of preference may include polycarbonate, nylon, fiberglass, ABS, polypropylene or polyethylene.

The present invention has been described with respect to the exemplary embodiments thereof, it will be recognized by those of skill in the art that many modifications or changes can be achieved without departing from the spirit and scope of the invention. Therefore it is manifestly intended that the invention be limited only by the scope of the claims and the equivalence thereof.

I claim:

1. A ball retrieval and storage device comprising:

a basket having opposing front wall and rear wall and two opposing side walls interconnected with said front and rear walls;

rotatable handle members secured to two opposing walls, said handle members rotatable from a handle orientation to a stand orientation;

a bottom wall comprised of a plurality of rod members including first fixed rod members and second, solid, non-hollow, displaceable rod members extending between opposing side walls or between opposing front wall and rear wall, said second, solid, non-hollow, displaceable rod members having a first end and a second end, said first and second ends disposed between a vertically divergent channel formed by said opposing side walls or opposing rear wall and front wall, said first and second ends of said second, solid, non-hollow, displaceable rod members having a securing means affixed to said first and second ends to maintain said rod members in said channel, said second, solid, non-hollow, displaceable rod members movable from a lower portion of said channel to an upper portion of said channel under the influence of downward pressure on a ball having an equator to be retrieved, said second, solid, non-hollow, displaceable rod members returning to said lower portion of said channel after said equator of said ball has passed there between, said second, solid, non-hollow, displaceable rod members formed of a material having elastic memory allowing said second, solid, non-hollow, displaceable rod members to deform slightly under the influence of said ball to be retrieved and to return to an original undeformed state.

2. A ball retrieval and storage device in accordance with claim 1 wherein said front wall, rear wall, and opposing side walls are of mesh construction having a plurality of intersecting horizontal and vertical rod members.

3. The ball retrieval and storage device in accordance with claim 2 wherein said vertical divergent channel is defined by said horizontal rod of said mesh construction and a pair of said vertical rod members of said mesh construction intersecting with said horizontal rod member and in vertical divergent orientation.

4. The ball retrieval and storage device in accordance with claim 1 wherein said bottom wall is formed by two first fixed rod members on an outer periphery of said bottom wall and a plurality of second, solid, non-hollow, displaceable rod members disposed in parallel relationship there between.

5. The ball retrieval and storage device in accordance with claim 1 wherein said second, solid, non-hollow, displaceable rod members are formed of an elastic memory material from the group comprising polycarbonate, nylon, fiberglass, ABS, polypropylene and polyethylene.

* * * * *